US010822915B2

(12) United States Patent
Fagna et al.

(10) Patent No.: US 10,822,915 B2
(45) Date of Patent: Nov. 3, 2020

(54) TANDEM RELEASABLE BRIDGE PLUG SYSTEM AND METHOD FOR SETTING SUCH TANDEM RELEASABLE PLUGS

(71) Applicant: Archer Oiltools AS, Sandnes (NO)

(72) Inventors: Jan-Ove Fagna, Tertnes (NO); Eirik André Revheim, Bru (NO)

(73) Assignee: ARCHER OILTOOLS AS, Sandnes (NO)

( * ) Notice: Subject to any disclaimer, the term of this patent is extended or adjusted under 35 U.S.C. 154(b) by 29 days.

(21) Appl. No.: 16/353,614

(22) Filed: Mar. 14, 2019

(65) Prior Publication Data

US 2019/0284898 A1 Sep. 19, 2019

(30) Foreign Application Priority Data

Mar. 14, 2018 (NO) ..... 20180368

(51) Int. Cl.

| | |
|---|---|
| ***E21B 33/124*** | (2006.01) |
| ***E21B 23/06*** | (2006.01) |
| ***E21B 34/14*** | (2006.01) |
| ***E21B 33/134*** | (2006.01) |
| ***E21B 33/12*** | (2006.01) |
| ***E21B 23/02*** | (2006.01) |
| ***E21B 23/00*** | (2006.01) |

(52) U.S. Cl.

CPC ..... *E21B 33/134* (2013.01); *E21B 23/006* (2013.01); *E21B 23/02* (2013.01); *E21B 23/06* (2013.01); *E21B 33/124* (2013.01); *E21B 33/1204* (2013.01); *E21B 33/1208* (2013.01); *E21B 33/1243* (2013.01)

(58) Field of Classification Search

CPC ..... E21B 23/06; E21B 34/14; E21B 33/1294; E21B 33/124; E21B 33/129; E21B 33/1291; E21B 33/1292; E21B 33/1281; E21B 33/128

See application file for complete search history.

(56) References Cited

U.S. PATENT DOCUMENTS 2,806,532 A 9/1957 Baker et al.
3,410,348 A * 11/1968 Page ..... E21B 33/1295 166/120

(Continued)

FOREIGN PATENT DOCUMENTS

WO WO 2014/0044843 A2 3/2014

*Primary Examiner* — Kipp C Wallace
(74) *Attorney, Agent, or Firm* — Birch, Stewart, Kolasch & Birch, LLP

(57) ABSTRACT

A method of setting a tandem releasable bridge plug system in a casing includes assembling a tandem bridge plug string including a lower bridge plug and an upper bridge plug. Both the upper bridge plug and the upper connector are initially disabled by a lock and unlockable from topsides; running in the tandem plug string on a drill pipe string until the lower plug is at its setting target depth in the casing; setting and shutting the lower plug; disconnecting the upper plug from the lower plug; pulling up the upper plug to its upper setting target depth in the casing, enabling the upper plug by releasing the lock; venting annulus gas to a central bore of the upper plug through a radial aperture below a packer of the upper plug and below a ball valve; shutting said ball valve in said central bore the upper plug; and disconnecting the drill pipe string from the upper plug.

24 Claims, 11 Drawing Sheets

(56) References Cited

U.S. PATENT DOCUMENTS

| | | | | |
|---|---|---|---|---|
| 3,455,381 | A * | 7/1969 | Page, Jr. | E21B 23/06 166/121 |
| 4,285,400 | A * | 8/1981 | Mullins, II | E21B 33/1295 166/120 |
| 4,794,989 | A | 1/1989 | Mills | |
| 4,928,762 | A | 5/1990 | Mamke | |
| 5,020,597 | A | 6/1991 | Braddick et al. | |
| 5,826,652 | A * | 10/1998 | Tapp | E21B 23/06 166/120 |
| 6,167,970 | B1 * | 1/2001 | Stout | E21B 23/04 166/151 |
| 9,279,307 | B2 * | 3/2016 | Williamson | E21B 33/1294 |
| 2004/0050546 | A1 | 3/2004 | Tinker | |
| 2004/0251024 | A1 | 12/2004 | Jones | |
| 2010/0038096 | A1 * | 2/2010 | Reimert | E21B 23/06 166/382 |
| 2015/0211334 | A1 * | 7/2015 | Richards | E21B 43/04 166/373 |
| 2019/0040699 | A1 * | 2/2019 | Perez | E21B 23/06 |
| 2019/0120006 | A1 * | 4/2019 | McCarthy | E21B 33/124 |
| 2019/0203550 | A1 * | 7/2019 | Geoffroy | E21B 33/12 |

* cited by examiner

Fig. 5B Upper connector 2U in disabled state due to ball seat sleeve (52)

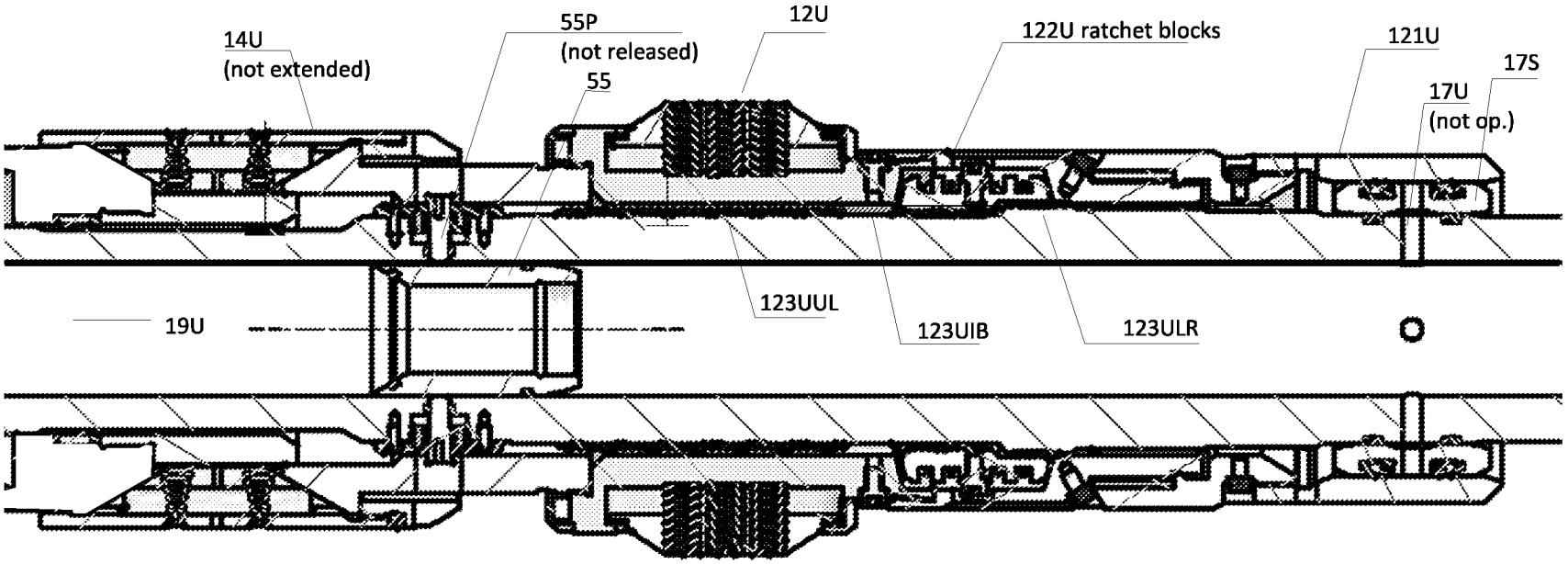
Fig. 5D: (Detail of Fig. 5)

TANDEM RELEASABLE BRIDGE PLUG SYSTEM AND METHOD FOR SETTING SUCH TANDEM RELEASABLE PLUGS

FIELD OF THE INVENTION

The present invention is a tandem releasable bridge plug system and a method for setting such tandem releasable bridge plugs in a casing.

BACKGROUND ART

Retrievable bridge plugs or "RBP" are well known in the well service industry. A single retrievable bridge plug carried on a drill pipe string may be set by the following actions:

- using drag blocks to set up a rotational resistance due to friction,
- rotating the string for setting slips,
- rotating the string for setting a packer,
- disconnecting the drill pipe string from the bridge plug,
- pressure testing the closed bridge plug from above by pressurizing the drill pipe string while the casing valve is closed.

A sequence of drill pipe string operations may be used for releasing an upper plug and running it further down into the hole in order to release a lower plug and then retrieving both on a common string. However, as will be explained below, despite such equally designed plugs may be pulled in one run, they may not easily be set in one run due to the manipulations on the drill pipe string will work on the upper plug only, and then the lower plug remains unset.

In the prior art presented in U.S. Pat. No. 9,279,307, two consecutive plugs in a well are removed in one run. However the US patent is not enabled to set two plugs in one run. The plug of the prior art has no through bore, and a special axially arranged release tool is required below the upper plug, and this is required before setting.

In the prior art U.S. Pat. No. 4,928,762 to Mamke, "Retrievable bridge plug and packer", he discloses a lower, retrievable bridge plug and an above casing annular packer.

U.S. Pat. No. 5,020,597 to Braddick et al., "Arrangement and method for conducting substance and lock therefor" describes a cementing string for a liner, with upper and lower wiper plugs with external seals thereon, releasably connected to the operating string. A lock arrangement prevents premature release of the upper and lower wiper by mechanical force, but is responsive to fluid pressure to first release the lower wiper prior to release of the upper wiper.

US patent application published as US2004/0050546 relates to an arrangement of sequentially configured packer J tools for one trip sequential setting of packer tools and for subsequent one trip sequential release of the tools.

U.S. Pat. No. 2,806,532 provides an improved method and apparatus for straddling casing perforations and for applying high pressures safely to the locations surrounding the casing perforations.

U.S. Pat. No. 4,794,989 discloses an apparatus for use in completing oil or gas wells having two or more perforated production zones which includes packers and assemblies for closing off the annular space between the tubing string and the well bore intermediate adjacent zones to isolate one from the other in order to produce from each individually.

US patent application published as US2004/0251024 describes a method for performing single trip perforation and packing operations via a downhole assembly in a cased well bore. The assembly is provided with an upper packer and a lower packer and has fluid communication established therethrough. The upper packer of the assembly is set to isolate a perforated production zone by introducing pressurized fluid through the assembly and against the casing below the lower packer of the assembly.

International patent application publication WO2014/0044843A2 Lipp, Interwell AS, describes a toolstring comprising a first and a second downhole tool, more specifically, an upper and a lower plug. The tool described in Lipp is a wireline bridge plug without any central bore. It is thus not designed for pressure testing the plug with regard to sealed-in pressure from below the plug. The dual plug tool is described as being able to set the first plug at a first location and the second plug in a second location, in one single run. The second plug is movable with the toolstring from the first location to the second location between setting the first plug and setting the second plug. The wireline bridge plugs of Interwell require electrical control signals via the wireline and Lipp provides no mechanism for distinguishing between a control signal for the upper plug from the control signal for the lower plug. Lipp suggests in p. 17, line 26-32 that test operations may be performed with the plug set and the toolstring detached, and subjecting the seal of the plug to a pressure test. Then the toolstring may be re-attached to the plug and pulled uphole. Such an operation would be undesirable, particularly for a wireline tool, due to the lack of knowledge of the pressure conditions below the plug to be pulled.

A problem in the drill pipe string operated bridge plug industry, since the lower plug is set by manipulating the drill pipe string movements through rotational left hand (RL) or rotational right hand (RH), and/or axial movements up or down, and if combining two similarly operated plugs, one may hardly control upon manipulating the drill pipe string rotationally and axially, which plug does what. One solution may be to design the plugs with mutually excluding different setting and releasing mechanisms but this requires much special preparation of each tool and a large stock of tools with separate setting and release mechanisms. The result, in practice, is that one may only set one plug on one drill pipe string at a time, requiring a second run for setting the second plug. So setting the plug may take twice the time compared to removing them.

Another problem arises if, during a drilling operation, an emergency situation develops and it may be decided to prepare for hanging off part of the drill pipe string in a bridge plug in the well, such as due to bad weather forecast. If time is sufficient, it is desirable to pull out as much drill pipe string as required, insert a hang-off bridge plug in the drill pipe string, and run into hole the hang-off bridge plug on the drill pipe string, and then set and close the hang-off bridge plug at a desired depth, carrying below it the remainder of the drill string. Then the drill string is disconnected from the hang-off bridge plug, and the drill string pulled out. The wellhead valves may now be temporarily closed. Further, it may subsequently be prepared for disconnecting the drilling casing without risk of petroleum fluid leakage.

In such the prior art with setting there is usually only time for setting the single hang-off bridge plug and there is thus no double barrier of bridge plugs within the casing. It would be desirable to run in a second and shallower set upper bridge plug in order to form the second barrier within the casing, disconnecting the above drill pipe string from the upper plug, and pulling out the drill pipe string and prepare for disconnect from the well. However such a second, upper bridge plug is time consuming and there may not be sufficient time for such a second bridge plug setting if the weather or sea state conditions worsen fast.

Another problem arises if the lower bridge plug must be set deep in a well, and an upper bridge plug must be set relatively shallow, then the distance from the lower bridge plug to the upper bridge plug is long. The time it takes to pull out the drill pipe string after having disconnected from the lower bridge plug may be unacceptably long, and time may be short for setting the second, upper bridge plug if the weather or sea state conditions worsen fast.

It is possible to arrange two bridge plugs on a common drill pipe string and set the first one in a first depth and the second one in a second depth, but this would require different setting and disconnecting mechanisms for the lower and upper bridge plug, respectively, in order not to set and disconnect from the upper plug while trying to set and disconnect from the lower plug.

A further problem arises if, using two plugs for searching and locating of a casing string leakage. One may run a lower plug on a first drill pipe string and then locate the lower bound of the leak, then run an upper plug on a second drill pipe string to locate the upper bound of the leak, and thus locate the location of the leak. Such a leak may be in a casing string of continuous even diameter, or it may be in a transition from one casing diameter to a liner diameter, i.e. for testing a liner hanger seal. The operation is time consuming due to the running in of plugs on two separate drill pipe strings.

SHORT SUMMARY OF THE INVENTION

A main object of the present invention is to disclose a tandem releasable bridge plug system and a method for setting such tandem releasable bridge plugs. The method for setting the releasable bridge plugs is defined as follows:

A method of setting a tandem releasable bridge plug system in a casing (0), characterized by the steps of:

assembling a tandem bridge plug string (1L,1U) comprising from bottom to top:

a lower bridge plug (1L) with mandrel (11U) with a through-bore (19L) having a main bore ball valve (18L) and arranged on a lower, disconnectable connector (2L), an upper bridge plug (1U) with a through-bore (19U) having a main bore ball valve (18U) and arranged on an upper, disconnectable connector (2U) which both the upper bridge plug (1U) and said connector (2U) are initially disabled by a lock (5) and unlockable from topsides, wherein disabling of said upper bridge plug (1U) and said connector (2U) is initially made by a ball seat axial sleeve (52) arranged in a collet sleeve (53) constituting the lock (5) of the connector (2U), the ball seat axial sleeve (52) releasable by a drop ball (51) to allow the collet sleeve (53) be forced upwardly and unlock the lock (5) enabling the upper connector (2U) to be axially and rotationally operable relative to the upper plug (1U) by the drill pipe string (4), and running in the tandem plug string (1L,1U) on a drill pipe string (4) until the lower plug (1L) is at its setting target depth (dL) in the casing (0);

setting the lower plug (1L); setting a packer (16L) of the lower plug (1L); pressure integrity testing the sealing effect of the lower plug's (1L) packer (16L) from below by pressurizing the drill pipe string (4) topsides, and shutting the ball valve (18L) of said lower plug (1L);

disconnecting the upper plug (1U) from the lower plug (1L);

pulling up the upper plug (1U) to its upper setting target depth (dU) in the casing (0), enabling the upper plug (1U) by releasing the lock (5);

setting the upper plug (1U) and opening a radial aperture (17U) from said through bore (19L) of said mandrel (11U), setting a packer (16U) of the upper plug (1U), said packer (16U) arranged above said radial aperture (17U); pressure integrity testing the sealing effect of the upper plug's (1U) packer (16U) from below by pressurizing the drill pipe string (4) topsides, and shutting the ball valve (18U) of said upper plug (1U);

disconnecting the drill pipe string (4) from the upper plug (1U).

The plug system used in the above method is a tandem releasable bridge plug system arranged for setting in a casing (0), said tandem bridge plug string (1L,1U) comprising from bottom to top:

a lower bridge plug (1L) having a mandrel (11L) with a through main bore (19L) with a main bore ball valve (18L) and arranged on a lower, disconnectable connector (2L) and an upper bridge plug (1U) having a mandrel (11U) with a through main bore (19U) with a main bore ball valve (18U) and arranged on an upper, disconnectable connector (2U), said tandem bridge plug string (1L, 1U) characterized in that said upper bridge plug (1U) on said upper, disconnectable connector (2U) both are arranged for being initially disabled by a lock (5) and unlockable from topsides, wherein disabling of said upper bridge plug (1U) is initially made by a ball seat axial sleeve (52) arranged in a collet sleeve (53) constituting the lock (5) of the connector (2U), the ball seat axial sleeve (52) releasable by a drop ball (51) to allow the collet sleeve (53) to be forced upwardly and unlock the lock (5), thus enabling the upper connector (2U) to be axially and rotationally operable relative to the upper plug (1U) by the drill pipe string (4), and said tandem plug string (1L, 1U) arranged for being run in on a drill pipe string (4) with said lower plug (1L) to a lower plug setting target depth (dL) in said casing (0);

said lower plug (1L) arranged for being set in said casing (0), and thereafter setting a packer (16L) of said lower plug (1L); said lower plug (1L) arranged for pressure integrity testing of its packer's (16L) sealing effect from below by pressurizing said drill pipe string (4) topsides, said lower plug (1L) arranged for being shut by closing said lower ball valve (18L), said lower connector (2L) arranged for disconnecting said lower plug (1L) from said upper plug (1U);

said upper plug (1U) arranged for being pulled up to an upper plug setting target depth (dU) in the casing (0), said upper plug (1U) arranged for being enabled by releasing said lock (5);

said upper plug (1U) arranged for being set by opening a radial aperture (17U) from said through bore (19U), setting a packer (16U) of said upper plug (1U), said packer (16U) arranged above said radial aperture (17U); said upper plug's (1U) packer (16U) arranged for being pressure integrity tested for its sealing effect from below by pressurizing the drill pipe string (4) topsides, said upper plug (1U) arranged for being shut by closing said upper ball valve (18U);

said upper connector (2U) arranged for disconnecting said upper plug (1U) from said drill pipe string (4) above it.

FIGURE CAPTIONS

The attached figures illustrate some embodiments of the claimed invention.

FIG. 1A shows run in hole for the assembled upper plug (1U) and lower plug (1L) until the latter is at its lower target depth (dL). In an embodiment both plugs are through-bore and initially their main bore valves are open.

FIG. 1B illustrates that weight and right hand (RH) rotation is exerted on the drill pipe string from topside, the lower plug is then set, but not necessarily closed. "Set" here may imply setting the slips and setting the expandable packer. Optionally pressure P may be set on the drill pipe string from topside to test the packer of the still open bore lower plug (1L) for below pressure integrity.

FIG. 1C illustrates left hand (LH) rotation to close the valve of the lower plug (1L).

Figures 1A, 1B, 1C, 1D:
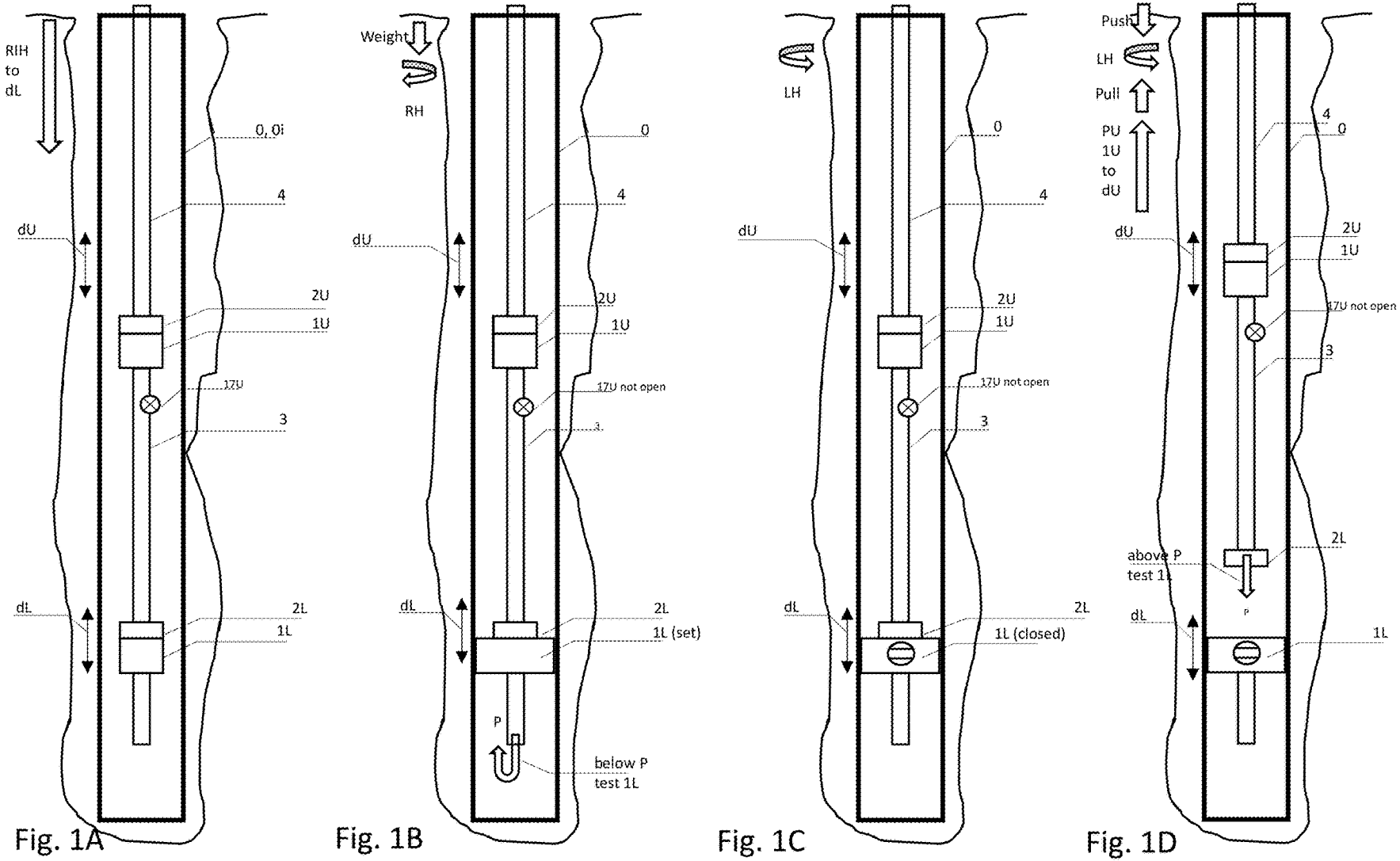
FIG. 1A-1I illustrates embodiments of invention's method; the steps of setting two plugs in a cased well.

FIG. 1D shows a further step of combined push and subsequent left-hand rotation (LH) combined with pull on the drill pipe string (4) to release the lower connector (2L) from the top of the lower plug. (Please also see FIG. 4). FIG. 1D shows pulling the upper plug (1U) to its target depth (dU). Now with the lower plug closed and the intermediate drill pipe string (3) open at its lower end (with the through bore connector (2L) open) one may optionally set pressure P on the drill pipe string from topside to test the now shut lower plug (1L) from above pressure. The above procedure is usually satisfactory on the first run, but if the pressure tests are not satisfactory it is still possible to open, release and reposition the lower plug (1L), and test again, because the upper plug (1U) is still un-enabled; it only works in principle as any drill pipe string section as part of the drill pipe string (4) and intermediate drill pipe string (3) all extending from topside. (except for its dragging drag blocks).

Figures 1E, 1F, 1G, 1H, 1I:
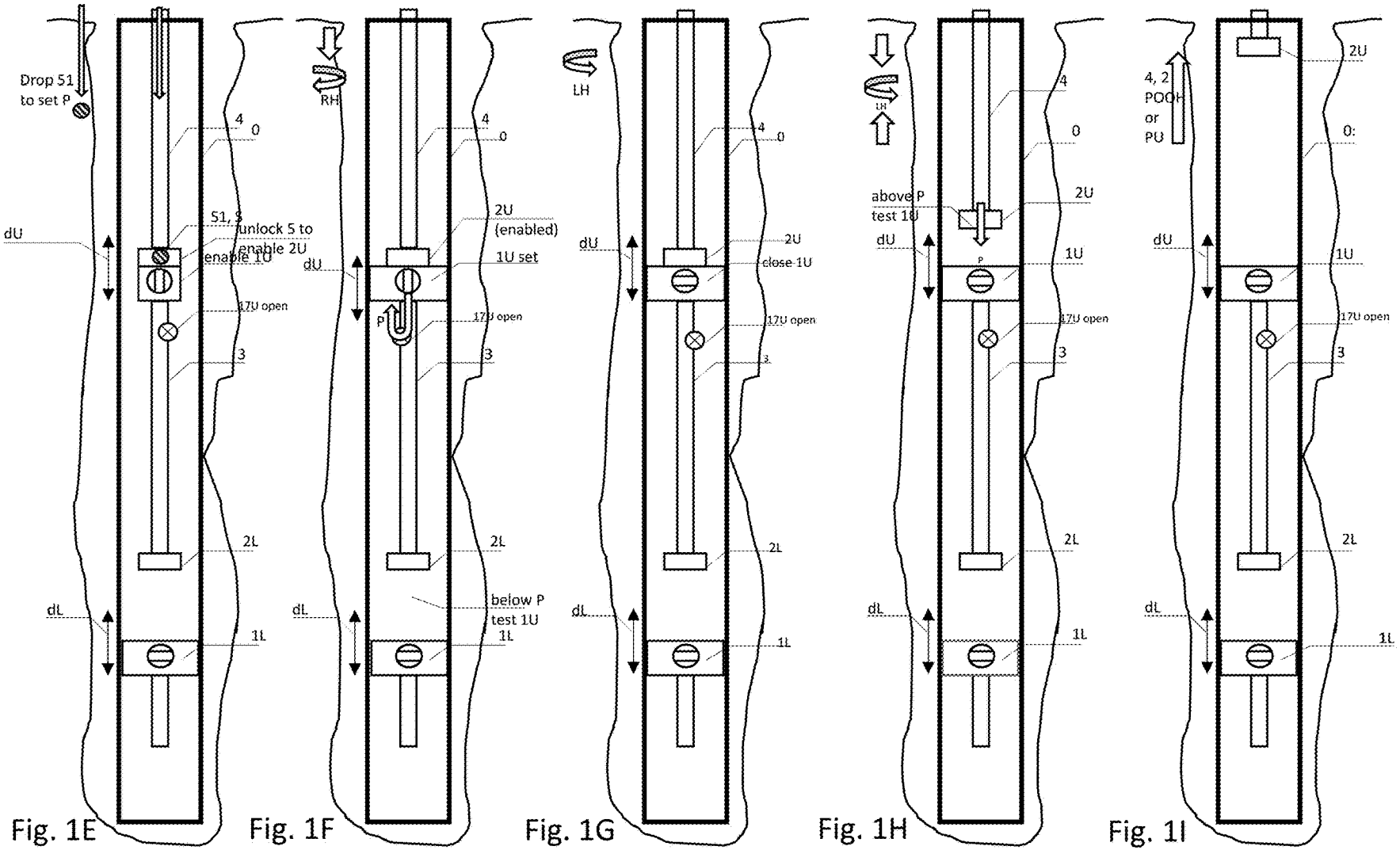

FIG. 1E illustrates a subsequent key step of the invention wherein a ball or dart is dropped to unlock and enable the upper plug (1U), i.e. in an embodiment of the invention, in practice, it unlocks the upper connector (2U) and the upper plug (1U) so as for enabling them to make the rotational and axial movements required to set and close the upper plug (1U) and to disconnect the upper plug (1U); please see the subsequent series of illustrated steps. From now on, the upper plug (1U) is operable from topside and in an embodiment it may be of the same type as the lower plug (1L), albeit not necessarily of the same dimension.

FIG. 1F shows setting the now enabled upper plug (1U), preferably by setting its slips and its expandable packer, both by weight down and right hand rotation, and an optional step of pressure testing the set packer of the upper plug (1U) from below.

FIG. 1G illustrates a subsequent step of closing the upper plug (1U) by left-hand (LH) rotation. Please notice that because one has disconnected the upper plug (1U) from the lower plug (1L), any rotational an axial movements for operating the upper plug (1U) does not affect the lower plug (1L) which is set, simply.

FIG. 1H illustrates a next step of pulling upward and left hand rotation (LH) in order to disconnect the upper connector (2U) from the upper plug (1U). Optionally one may now pressure test from above. It is now possible to reconnect, open, release, and reposition the upper plug (1U) if the pressure test is not satisfactory.

FIG. 1I shows that the two plugs are now set in their target depths and from the topside one may pull up (PU) or pull out of hole (POOH) with the drill pipe string (4) and the upper connector (2U).

FIG. 2A to D illustrates an embodiment of the upper plug (1U) in a longitudinal section, the proximal end to the left.

Figure 2A:
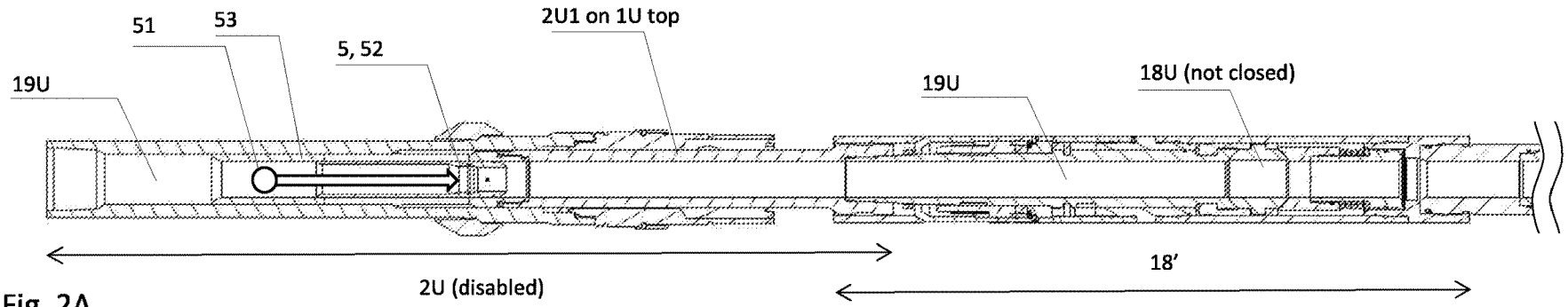

FIG. 2A shows a run in hole state the longitudinal section of the upper plug (1U) with the disconnectable connector (2U) to the left, having a lock unit (5) for temporarily inactivating the connector (2U); a ball valve section (18'); a packer and slip section (16U, 14U) with drag blocks (12U). A ball (51) is shown being dropped and about to land in the ball seat of the ball seat axial sleeve (52), thus enabling the collet sleeve (53), which has inward yielding collet splines, to be moveable under axial force within the upper connector sleeve (2U) when released. The ball valve (18U) is not closed. The through central bore (19U) of the tool is open. The slips (14U) are not extended. The packer (16U) is not set. The drag blocks (12U) are extended and will drag on the casing wall.

Figure 2B:
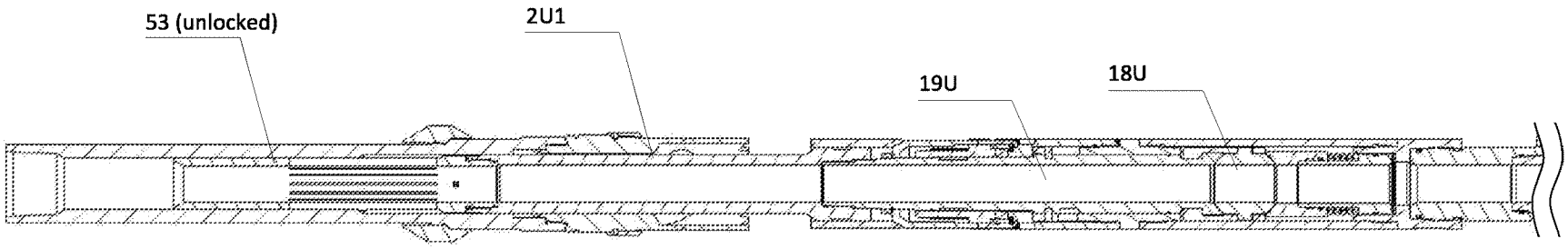
Figure 2A:
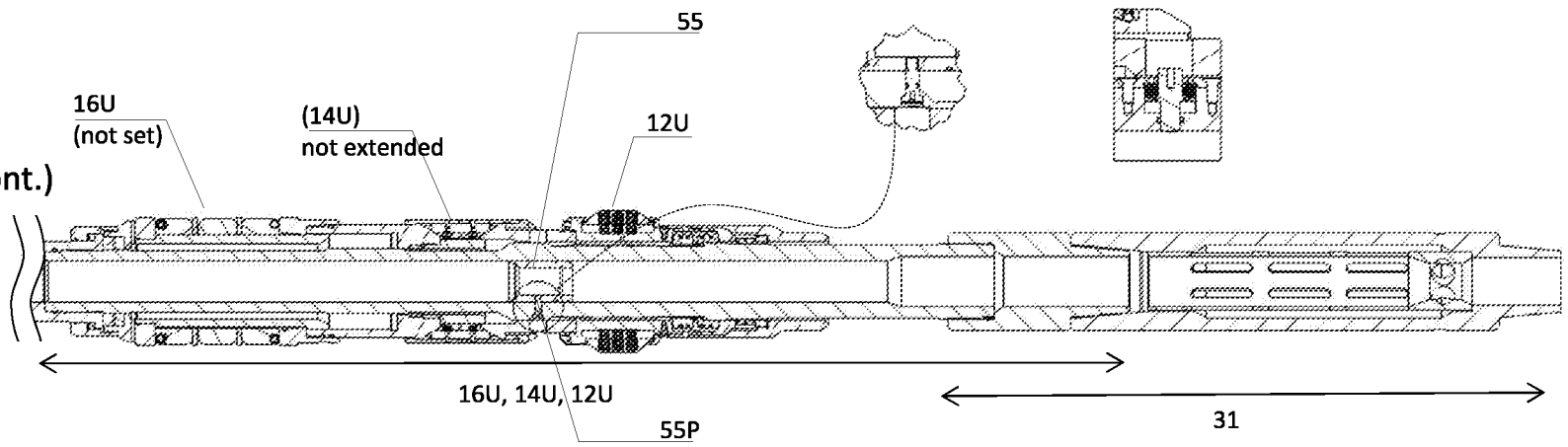
Figure 2B:
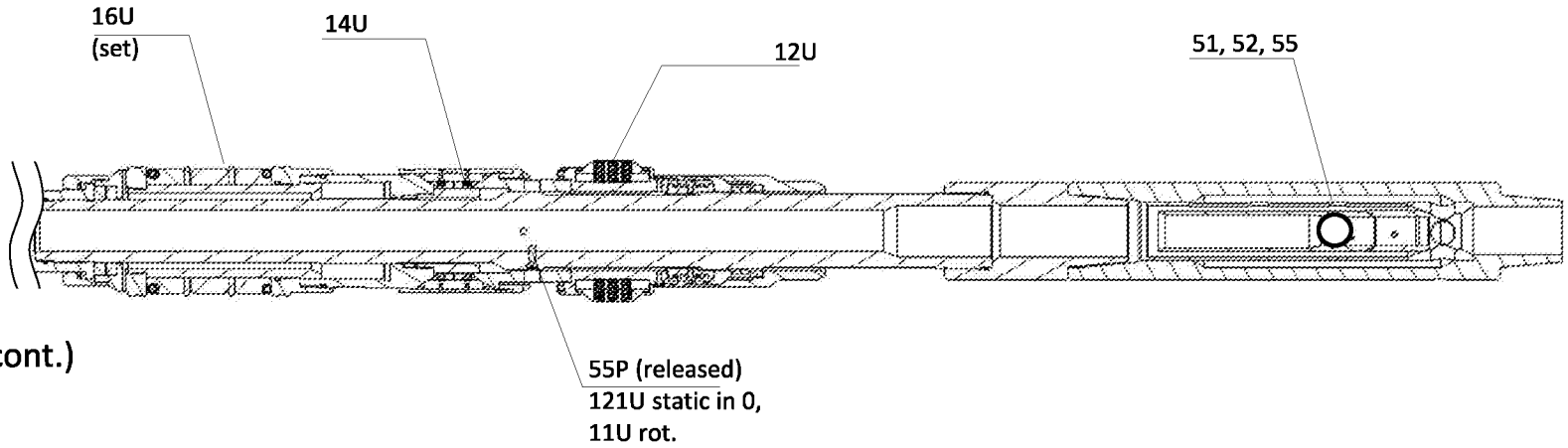

FIG. 2B shows the ball (51) having released the ball seat axial sleeve (52) which has passed through the tool (1U) and has sheared out shear pins (55*s*) and released the second shear seat (55) which so far had held the anti-rotation pins (55P) which disable independent mandrel (11U) rotation of the setting mechanism for the RH rotation of the slips (14) and the compression of the packer (16). Please see the ball (51), the ball seat axial sleeve (52) and the second shear seat (55) now caught in the ball catcher.

Figure 2C:
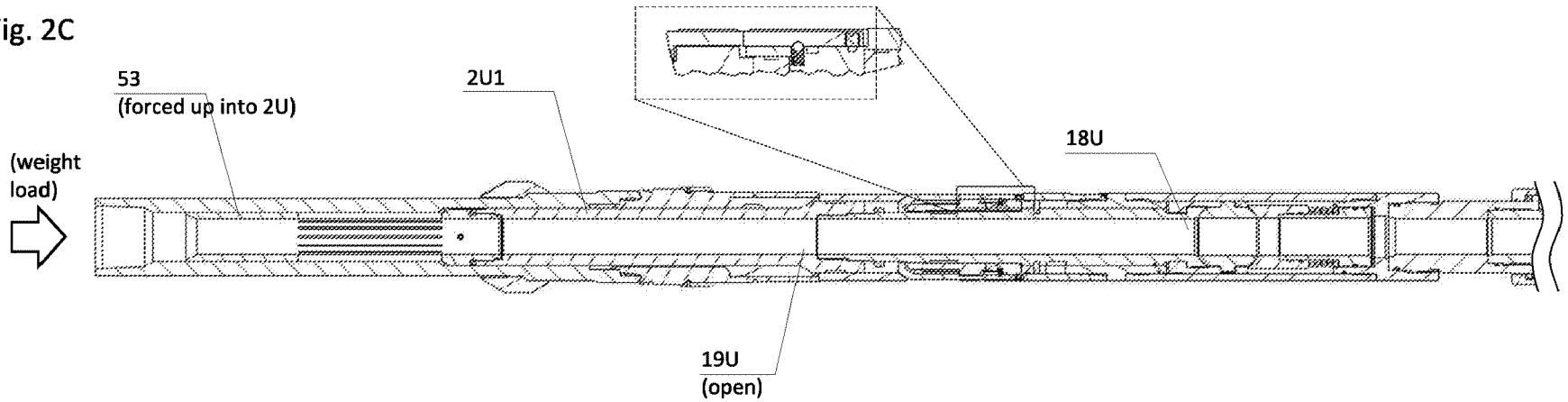

FIG. 2C illustrates the further step of setting the plug and unlocking the ball valve by screw-compressing the packer and slip section (14U, 16U), the mandrel (11U) no longer held by the anti-rotation pins (55P), and the barrel friction held by the drag blocks against the casing wall (0*i*), to extend the slips (14U) and set the packer (16U). The collet sleeve (53) is pushed upwardly in by stinger (2U1) to allow axial movement of the J-slot mechanism.

Figure 2D:
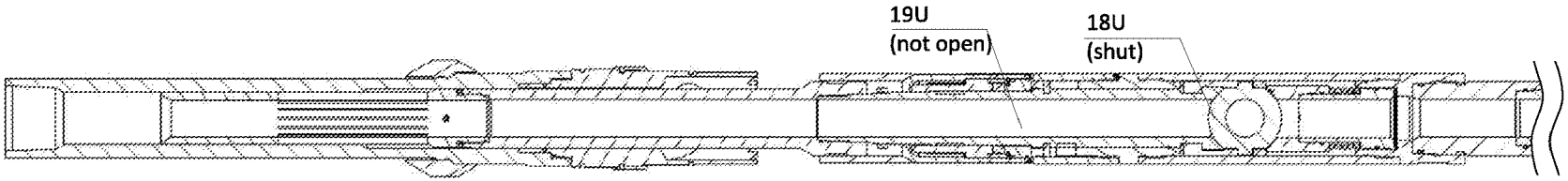
Figure 2C:
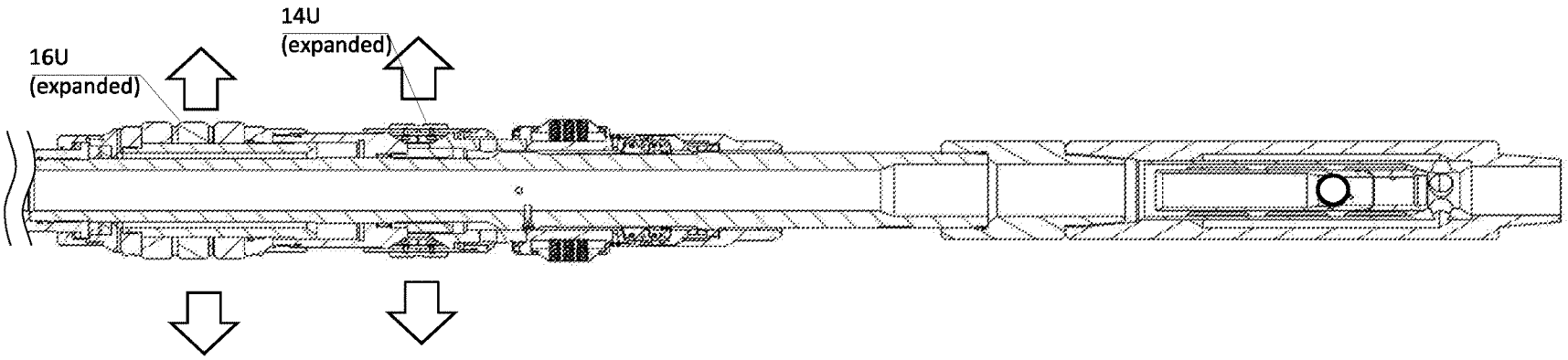
Figure 2D:
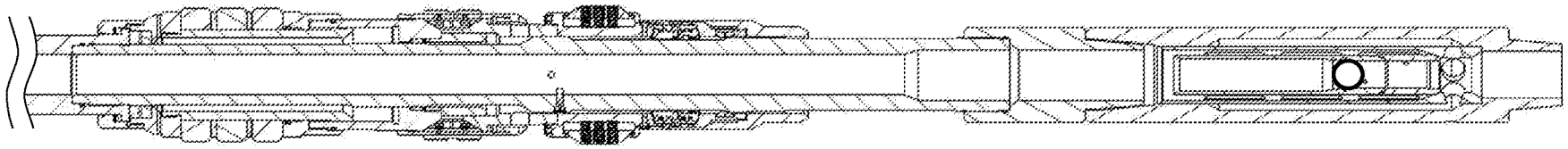

FIG. 2D shows the further step wherein the plug has been set and the ball valve is closed, comprising shutting the ball valve (18U), thus closing the central bore (19U).

Figure 3A:
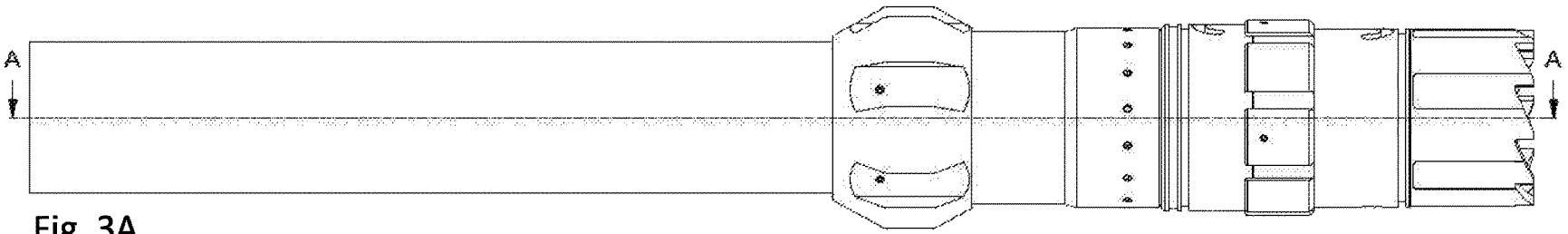

FIG. 3A is a lateral view of the upper connector sleeve (2U).

Figure 3B:
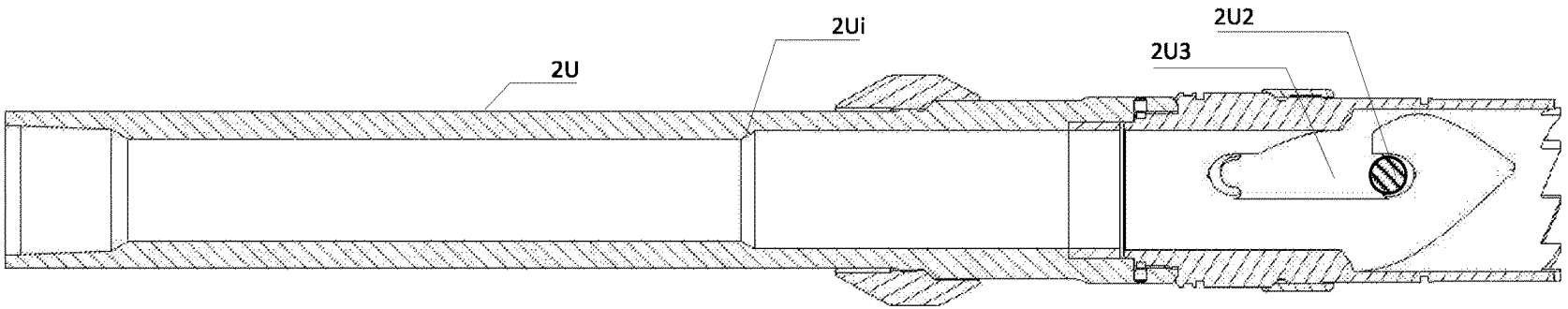

FIG. 3B is a longitudinal section view of the upper connector sleeve (2U), i.e. the sleeve portion of the connector (2U) which shall combine with the upper plug's (1U) top stinger portion (2U1). Please see FIG. 2A, 2B, 2C for their operations in sequence. In the central bore (19U) of the upper connector (2U) sleeve there is arranged a collet sleeve (53) temporarily blocked by lock unit (5) for temporarily inactivating the connector (2U), which is enabled by dropping a ball (51). Please see below for ball seat lock details. Further FIG. 3B depicts an internal shoulder (2Ui) for knobs on inward yielding, outward dented collet sleeve (53) to be held back before sheared out seat (52) is removed. Upper connector (2U) has J-slots (2U3) for dogs (2U2) on the upper stinger (2U1). The J-slots are arranged for downward push and left hand (LH) rotation of the drill string (4) to release from the upper plug (1U).

Figure 4:
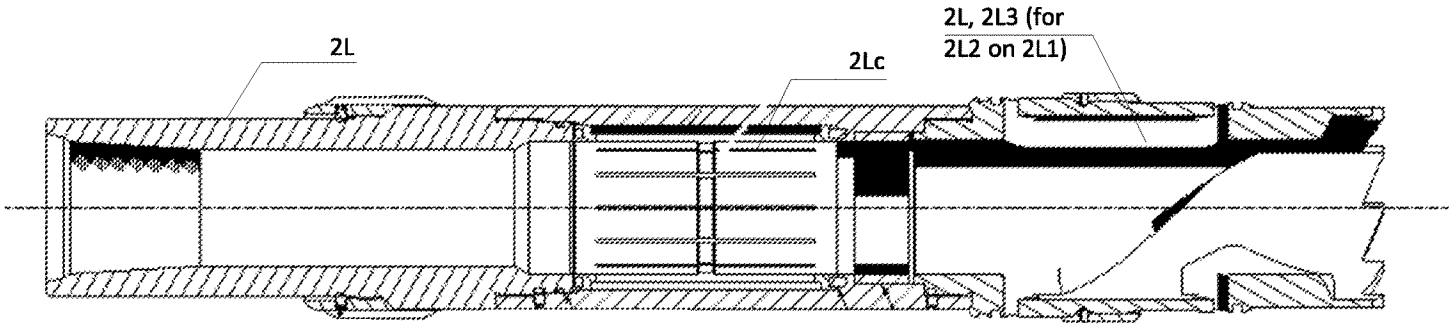

FIG. 4 shows the lower connector sleeve (2L) in a longitudinal section view. It shows an embodiment of the invention wherein the lower connector (2L) is arranged for being subject to weight, then a lower connector collet (2Lc) collapses by yielding outwardly and allows that the running and retrieval tool (the lower connector 2L) with its internal J-slots may be pushed downward on its stinger portion (2L1) with radial dogs (2L2), so as for the radial dogs to be guided upwardly in the J-slot (2L3), then we rotate to the left (LH)

and pull up. Now the lower connector (2L) is free from the lower plug's (1L) stinger portion (2L1) at its top.

Figure 5:
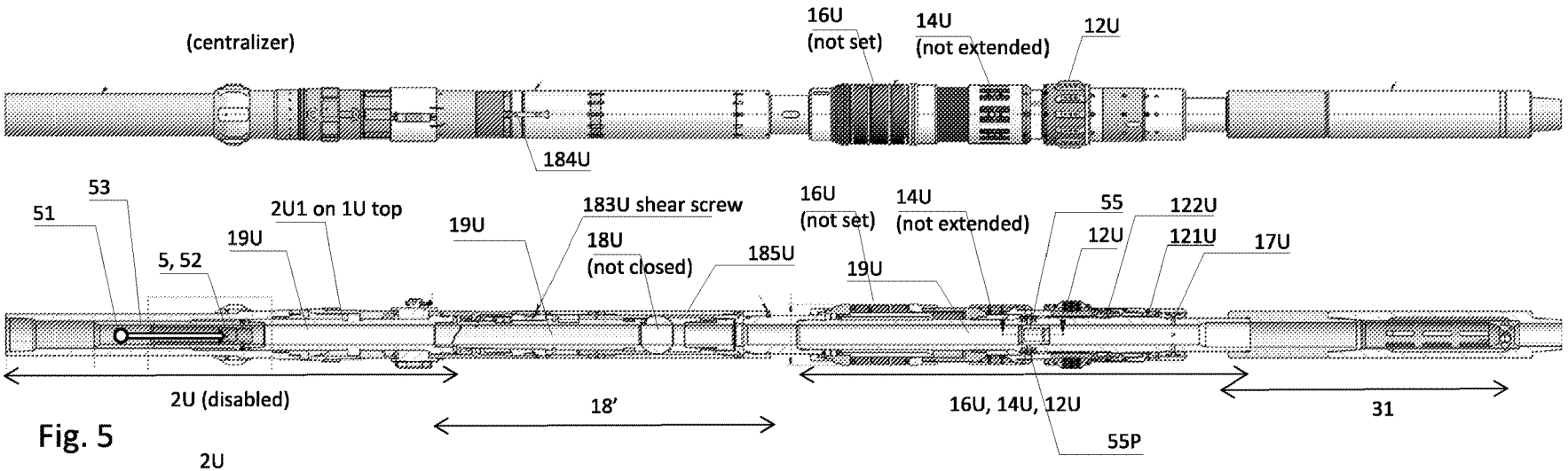

FIG. 5 is a lateral view of an embodiment of the invention wherein the upper plug (1U) with its connector (2U) is shown, also in longitudinal section view. up is to the left where the drill pipe string (4) shall be connected, down is to the right where the intermediate drill pipe string (3) and/or the lower connector (2L) with the lower plug (1L) shall be connected.

FIG. 5B is an enlarged view of the lock (5) in the upper connector (2U) from FIG. 5.

Figure 5C:
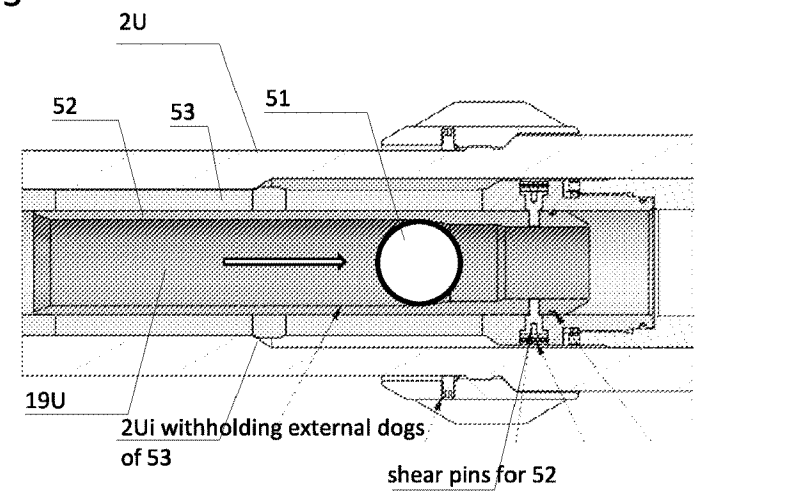
Figure 5C:
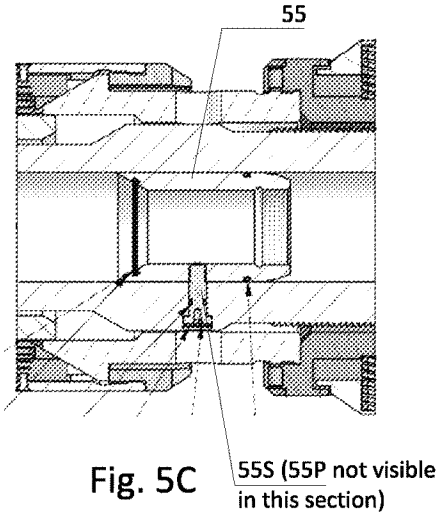

FIG. 5C is an enlarged view of the second shear seat (55) from FIG. 5.

FIG. 5D is an enlarged view of the drag block barrel (121U) and the mandrel (11U) of FIG. 5.

Figure 6:
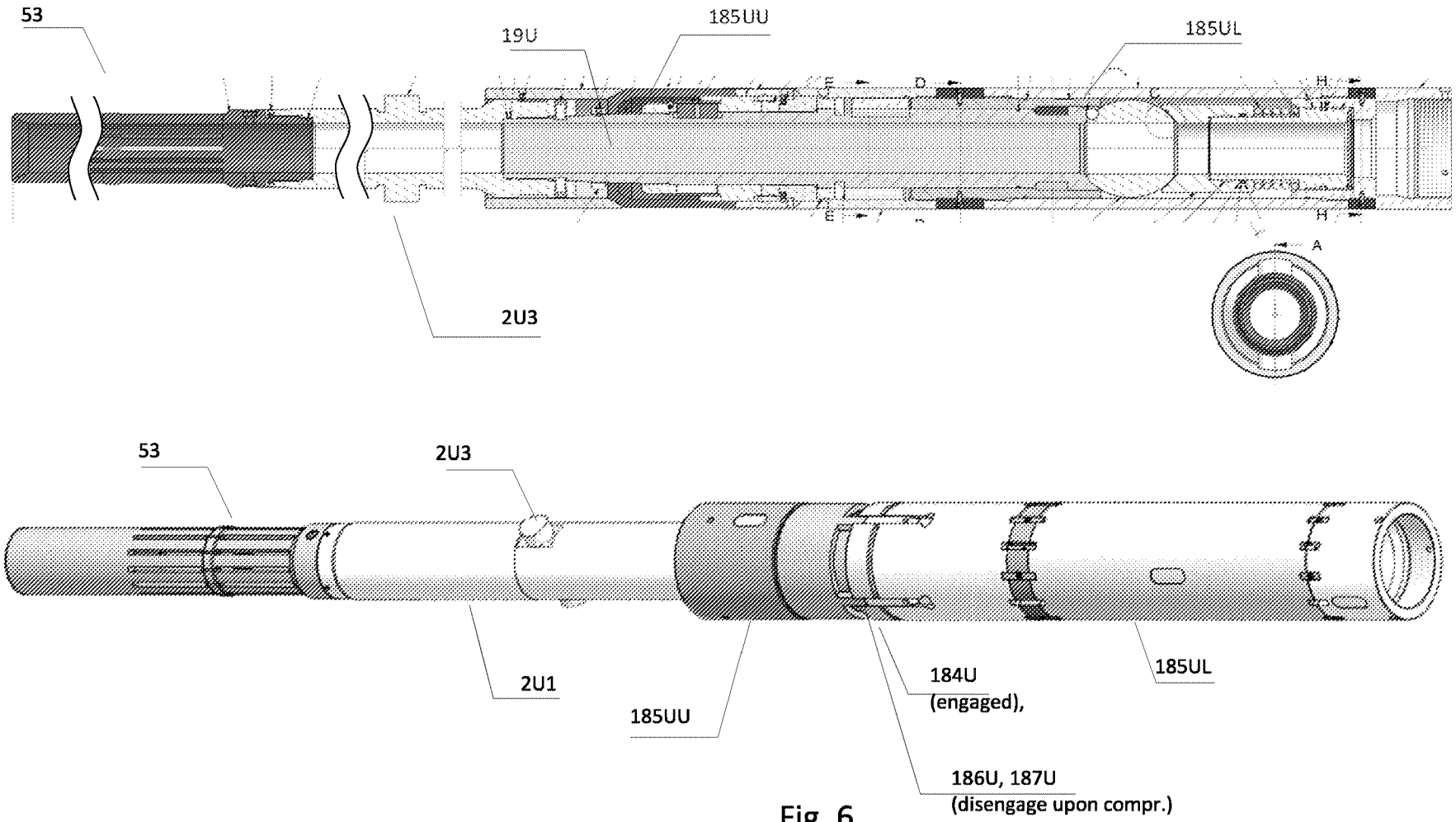

FIG. 6 is a longitudinal section of the spline sleeve (53) of the lock (5) to cooperate with the upper connector (2U), the upper stinger (2U1), the ball valve section (18'U) of the upper plug (1U). Also is shown the same components in a perspective view. Please notice the here engaged clutch mechanism which will force common rotation of the upper barrel and the lower barrel of the ball valve section (18'U) which will be disengaged to allow differential rotation upon being compressed once axially, thus enabling rotational closing or opening of the ball valve element (18U).

Figure 7:
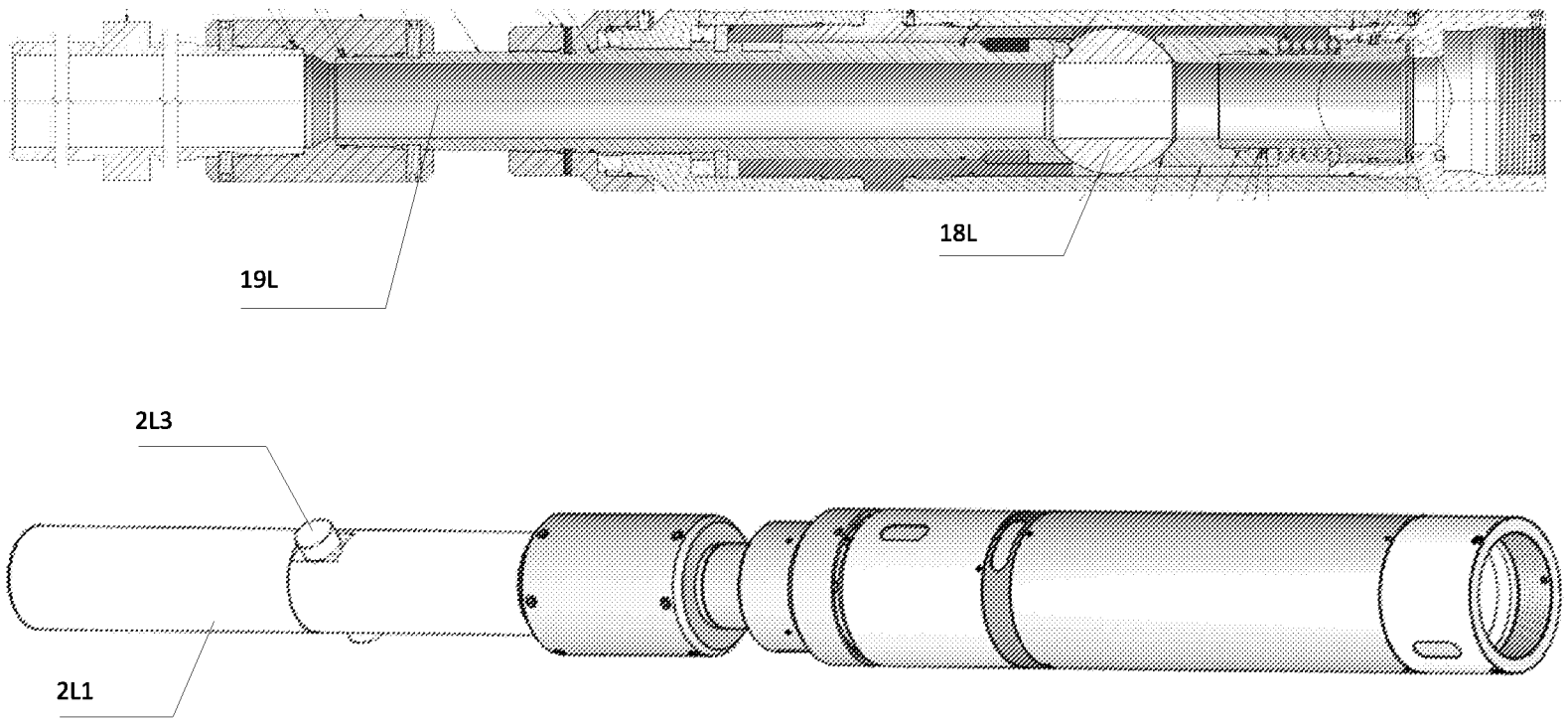

FIG. 7 is the corresponding views of the lower ball valve section as compared to FIG. 6.

THE INVENTION AND EMBODIMENTS OF THE INVENTION

The invention will in the following be described and embodiments of the invention will be explained with reference to the accompanying drawings.

The invention is a method of setting a tandem releasable bridge plug system in a casing (0). The method comprises, the steps of:

- assembling a tandem bridge plug string (1L,1U) comprising from bottom to top the following elements:
  - a lower bridge plug (1L) on a lower disconnectable connector (2L),
  - an upper bridge plug (1U) on an upper disconnectable connector (2U) who both are initially disabled by a lock (5) and unlockable from topsides.
- running in the tandem plug string (1L,1U) on a drill pipe string (4) until the lower plug (1L) is at its setting target depth (dL) in the casing (0), please see FIG. 1,
- setting and shutting the lower plug (1L),
- disconnecting the upper plug (1U) from the lower plug (1L),
- pulling up the upper plug (1U) to its upper setting target depth (dU) in the casing (0),
- enabling the upper connector and the upper plug (1U) by releasing the lock (5);
- setting and shutting the upper plug (1U);
- disconnecting the drill pipe string (4) from the upper plug (1U).

After the above steps one may pull out the drill pipe string (4) from the well, depending on the subsequent operation to be made on the well.

The disconnectable connectors (2U, 2L) are both usually named "running and retrieving tool" of which an upper sleeve portion, please see FIG. 4 is for being coupled to the lower end of a running drill pipe string, here the drill pipe string (4) or and the intermediate drill pipe string (3), respectively, and the corresponding lower half being a cylindrical receptacle sleeve portion for receiving a stinger (2U1, 2L1) which belong to the upper retrievable bridge plug (1U) and the lower retrievable plug (1L), respectively. The stingers (2U1, 2L1) with two dogs (for fitting into corresponding 3-slots (2U3, 2L3) respectively. For the lower disconnectable connector (2L) please see FIG. 2A in its initial, locked and non-enabled state.

The setting of the upper plug's (1U) slips (14U) and packer (16U) is facilitated as follows:

Upper Plug General Structure

In an embodiment of the invention, the upper plug comprises from bottom to top, a drag block section with upper drag blocks (12U) and a lateral aperture (17U), a set of slips (14U) here named "upper" slips (14U), a set of packers (16U) hereafter named "upper" packers (16U), a ball valve section (18'U) with an "upper" ball valve element (18U), a stinger (2U1) with J-slot dogs arranged for connecting to an upper connector (2U) with J-slots, also called a "running tool", the upper connector mounted at the lower end of a drill pipe string (4) for running in the upper plug (1U) and the lower plug (1L) into the well. In an embodiment of the invention the upper plug has the lock (5) initially disabling the slips and packer functions of the upper plug (1U) except for its drag blocks, so as for initially making it to operatively appear as a drill pipe string section, thus enabling normal operations on the lower plug (1L).

In an embodiment of the invention, the upper plug's (1U) mandrel (11U) has an axial through-bore (19U), and is provided with an outer drag block barrel (121U) which is arranged for, when not prevented by anti-rotation pins (55P), to rotate about the mandrel (11U) when the upper plug (1U) with its connector (2U) has been activated. On its surface, the drag block barrel (121U) is provided with drag blocks (12U) which are spring loaded to drag on the inner wall (0*i*) of a surrounding casing pipe (0) forming part of the well. Those drag blocks (12U) are always engaged in friction against the surrounding wall. When activated, i.e. when the anti-rotation pins (55P) do not lock the drag block barrel (121U) to the mandrel (11U), the mandrel may be screwed right-hand (RH) downwardly in the drag block barrel (121U). In an embodiment of the invention, weight is then put on the drill pipe string (4) including the mandrel (11U), thus the drag block barrel (121U) is forced upward relative to the mandrel (11U) so as for an above arranged slip wedge (141U) to wedge force out the slips (14U), which further leads to compression of said further above upper packers (16U). The setting mechanism is releasable so as for allowing resetting or retrieval of the plug (1U).

Ratchet Block/Ratchet Lock Mechanism

According to an embodiment of the invention, internally, the drag block barrel (121U) has an inward facing annular pocket for holding spring-loaded ratchet blocks (122U) with threads arranged for running on a composite thread portion (123U) of the mandrel (11U), the composite thread portion comprising an upper, left-hand thread portion (123UUL), an intermediate blank section (123UIB), and a lower right-hand threaded portion (123ULR), so as for enabling axial movement of the mandrel (11U) relative to the drag block barrel (121U).

In an embodiment of the invention, the lower, right-hand threaded portion (123ULR) has a larger diameter than the upper, left-hand threaded portion (123UUL). Similarly, the ratchet blocks (122U) have a larger diameter in a lower portion for engaging the lower, right-hand threaded portion (123ULR) and a smaller diameter at an upper portion for engaging the upper, left-hand threaded portion (123UUL).

In an embodiment of the invention, the upper plug (1U) is run into the well with its ratchet blocks (122U) engaged on the lower, right-hand threaded portion (123ULR) so as for the upper slips (14U) and upper packers (16U) to be locked in their un-engaging position, i.e. prevented from leaving their retracted positions. Thus one may rotate the drill pipe string (4) and the mandrel (11U) a number of right-hand (RH) turns in order to screw the lower, right-hand threaded portion (123ULR) down through the wider portion of the ratchet blocks (122U), until the intermediate, smooth, thread-free portion (123UIB) is allowed to slip-pass through the ratchet blocks (122U). This may be arranged to require 5 to 12 turns RH. From then, one may lay weight onto the drill pipe string (4) thus the mandrel (11U) with its upper, left hand (LH) threaded portion (123UUL) may ratchet downwardly for a distance into the ratchet blocks (122U). This will lead to engagement of the slips (14U) and the packers against the casing wall (0*i*).

In an embodiment of the invention, turning the mandrel (11U) left (LH) will further tighten the grip of the slips and the packer.

In an embodiment of the invention, the turning of the mandrel (11U) left-hand (LH) will close the ball valve (18U). The right-hand turning described for activating the slips and packer above will not affect the already open ball valve (18U).

Upper Ball Valve Section

In an embodiment of the invention, the upper ball valve (18U) is preferably open during running in of the upper plug (1U)/lower plug (1L). The upper ball valve section (18'U) is kept in a passive state when running in so as for the upper ball valve (18U) not to be inadvertently shut due to possible left hand (LH) rotation during running in. Further, the upper ball valve (18U) shall be arranged also not be affected while the lower plug (1L) is manipulated through axial movements and rotational movements made by the drill pipe string (4). In an embodiment of the invention, the upper stinger (2U1) connected and initially locked by the lock (5) in the connector (2U) and arranged on top of the upper ball valve section (18'U), i.e. the ball valve section of the upper plug (1U), is connected to an upper barrel (185UU) with a clutch (184U) to a lower barrel (185UL) which holds the upper ball valve element (18U), please see FIG. 6. Here is shown the non-activated state wherein the clutch (184U) engages rotationally the upper barrel (185UU) to the lower barrel (185UL), forcing common rotation. When the lock (5) is released, the upper stinger (2U1) may axially compress the upper barrel and the lower barrel against a return spring force and release the two barrels rotationally from each other because the initially engaging finger-and-slot arrangement (186U, 187U) will disengage in their compressed position, see FIG. 6, so as for left-hand (LH) rotating the upper barrel (185UU) relative to the lower barrel (185UL) may occur thus closing the ball valve element (18U).

In the embodiment of the invention, the upper ball valve section (18U) thus has have a delayed-activation mechanism which enables the ball valve (18U) to be left-hand (LH) rotated to a closing position in the main bore (19U) after the packer (16U) has been set. This mechanism involves an initial anti-rotation mechanism activated by a sleeve further activated by the axially contracted connection between the stinger (2U1) at the top of the ball valve section (18U') and the upper connector sleeve (2U). In order to close the upper ball valve (18U), one must engage the upper ball valve (18U) mechanism, and turning left for a half turn will close the upper ball valve (18U). In order to open the upper ball valve (18U), one may turn the mandrel right-hand (RH), one half turn.

In an embodiment of the invention, the lower ball valve section (18'L), please see FIG. 7, has no such initially un-enabled clutch mechanism and will close upon being left hand (LH) rotated, please see FIG. 7. It may be opened again by rotating half a turn to the right (RH).

Lower Bridge Plug:

In an embodiment of the invention the Lower plug (1L) is rather similar to the upper plug (1U) with the significant differences that it has no anti-rotation pins (55) preventing relative rotation of its mandrel (11L) relative to its drag block barrel (121L), no lock (5), no disabling clutch mechanism preventing shutting the lower ball valve element (18L) by left-hand rotation and axial load. The mechanism for enabling the lower plug's (1L) slips (14L), and its lower packers (16L) thus involves right hand (RH) rotation of the mandrel (11L) in the lower drag block (12L) barrel (121L) to activate the slips (14L), down weight to ratchet the mandrel (11L) downwardly in the barrel (121L) to engage and set the lower slips (14L) and lower packer (16L). Left-hand rotation will close lower ball valve element (18L), and right hand rotation of the mandrel (121L) to open lower ball valve (18L). Right hand (RH) rotation to release the lower slips (14L) and packer (16L) and then pull to ratchet the mandrel (11L) to its parked state and thus release the lower plug (1L) fully.

Ratchet Block/Ratchet Lock Mechanism

In an embodiment of the invention, internally, the drag block barrel (121U) has an inward facing annular pocket for holding spring-loaded ratchet blocks (122U) with threads arranged for running on a composite thread portion (123U) of the mandrel (11U), the composite thread portion comprising an upper, left-hand thread portion (123UUL), an intermediate blank section (123UIB), and a lower right-hand threaded portion (123ULR), please see FIG. 5D, so as for enabling axial movement of the mandrel (11U) relative to the drag block barrel (121U).

In an embodiment of the invention, the lower, right-hand threaded portion (123ULR) has a larger diameter than the upper, left-hand threaded portion (123UUL). Similarly, the ratchet blocks (122U) have a larger diameter in a lower portion for engaging the lower, right-hand threaded portion (123ULR) and a smaller diameter at an upper portion for engaging the upper, left-hand threaded portion (123UUL).

In an embodiment of the invention, the upper plug (1U) is run into the well with its ratchet blocks (122U) engaged on the lower, right-hand threaded portion (123ULR) so as for the upper slips (14U) and upper packers (16U) initially to be locked passive, i.e. prevented from leaving their retracted positions. Thus one may rotate the drill pipe string (4) and the mandrel (11U) a number of right-hand (RH) turns in order to screw the lower, right-hand threaded portion (123ULR) down through the wider portion of the ratchet blocks (122U), until the intermediate, smooth, thread-free portion (123UIB) is allowed to slip-pass through the ratchet blocks (122U). This may be arranged to require five to twelve turns RH. From then, one may lay weight onto the drill pipe string (4) thus the mandrel (11U) with its upper, left hand (LH) threaded portion (123UUL) may ratchet downwardly for a distance into the ratchet blocks (122U). This will lead to engagement of the slips (14U) and the packers against the casing wall (0*i*). Turning the mandrel (11U) left (LH) will further tighten the grip of the slips and the packer.

The Radial Aperture

A problem may arise upon reconnecting the drill pipe string (4) extending from topsides via the upper connector (2U) to the upper bridge plug (1U) in its closed state, if the upper bridge plug (1U) is connected to an intermediate drill pipe string (3) extending below the upper bridge plug (1U). Upon having reconnected to the upper plug (1U) the upper ball valve (18U) in the upper plug's (1U) bore (19U), one may test for the pressure below the upper plug (1U). Due to influx of fluids (liquids and gases), pressure may have built up in the intermediate zone below the upper plug (1U) and above the lower plug (1L) during the time when they both have been closed, a period which may have lasted for a few hours, but which may be a period of several months in some applications for which the present plug have been tested. Gas may have accumulated. Opening the upper ball valve (18U) will allow measuring the pressure below the upper plug (1U), and also be enabled to detect the presence of gas in the intermediate drill pipe string (3), but one will not know whether gas has accumulated in the annulus (3A) about the intermediate drill pipe string (3). Such undetected gas may incur problems when releasing the upper packer (16U) and releasing gas unnoticed up into the annulus about the drill pipe string (4), before and when releasing the upper plug (1U) slips (14U), said gas then migrating up past the upper packer (16U) which may create an undesired gas present in the casing of the upper part of the well.

The problem of possible annular gas below the upper packer (16U) and about the intermediate drill pipe string (3) is remedied in an embodiment of the invention wherein a radial aperture (17U) orthogonally into the axial bore (19U) of the upper mandrel (11U) of the upper plug (1U). Gas drained out through the drill pipe string (4) is easier to control. The radial aperture (17U) is initially covered by the drag block (18U) barrel (181U) when running the upper plug (1U) into the well, and an annular seal (17*s*) arranged internally and near the lower end of the drag block barrel (121U), seals the radial aperture (17U) when closed. When the upper plug's (1U) radial aperture (17U) shall be opened, the drill pipe string (4) rotates the mandrel (11U) a number of right hand (RH) turns within the threaded blocks ( ) of the drag block barrel (181U) until the radial aperture (17U) is uncovered below the seal (17S). The open radial aperture (17U) then allows communication between the annulus of the lower plug below the packer (16U) and the axial bore (19U). In this way, the radial aperture (17U) from the upper axial bore (19U) to its annulus is opened to allow gas present in the annulus to balance itself into the axial bore (19U) and the bore of the upper part of the intermediate drill pipe string (3), when the upper packer (16U) is set, and it will remain open as long as the upper packer (16U) is set.

Please notice that in the initial state, also the radial aperture (17U) of the mandrel (11U) is closed because the portion of the mandrel (11U) in which it is made, is initially retracted into the drag block barrel (121U), and will only be uncovered when a number of right hand (RH) turns are made using the drill pipe string (4). This closed radial aperture (17U) and the otherwise locked and disabled state of the upper plug (1U) means that to the surface operator, he may communicate via drill pipe string pressure with the lower tool (1L) in order to set using the drill pipe string (4, 3) and conduct a pressure test through the drill pipe string (4, 3) of the lower tool (1L) from below. It is undesirable to leave the radial aperture (17U) open after having re-connected the upper connector (2U) to the upper plug (1U) and released the upper plug (1U) and then connecting to the lower plug (1L), because then one could not conduct a re-entry pressure-from-below test of the lower plug (14 the radial aperture (17U) would have to be closed in order to have a through-drill pipe string connection through the lower, opened plug (1U).

Releasing the Upper Plug

In an embodiment of the invention, in order to open the upper ball valve (18U), one may turn the mandrel right-hand (RH), one half turn. In order to release the upper packer (18U) and upper slips (14U), one may make a required number of right hand (RH) turns in order to unscrew the LH threaded portion (123UUL) back up through the ratchet blocks, and, when free of the upper thread portion, pull up the drill pipe string (4) thus the mandrel (121U) to ratchet onto the lower set of right-hand threads (123ULR), thus preventing later undesired setting of the upper packer (18U) and upper slips (14U). The upper plug (1U) may then be pulled out of hole or pulled to another depth to be set.

In an embodiment of the invention, the length of the upper threaded portion of the ratchet blocks (122U) is a little bit shorter than the length of the blank portion (123UIB).

In an embodiment of the invention, the ratchet blocks' (122U) lower threaded portion has threads cut inclined to enable being ratched downwardly on the lower threaded portion (123ULR), but not upwardly. For the ratchet blocks' (122U) upper threads it is oppositely inclined cut so as for enable being ratched upwardly on the upper threaded portion (123UUL) of the mandrel (11U).

A big issue is how to set the lower bridge plug (1L) without setting or releasing the similarly operated upper bridge plug (1U), then release the upper bridge plug (1U) from the lower bridge plug (1L), and first now enabling the mechanism for initiating and conducting setting and release of the upper bridge plug (1U). In this way the tandem plugs (1L, 1U) may be set on one and the same run.

Lower Plug Repositioning Possible:

Before the upper plug (1U) is enabled, the lower plug (1L), if set improperly and a leakage is detected, it may be right-hand screwed and may be repositioned, then reset and tested, until its operational required slip holding force and sealing property is met. After the upper plug (1U) is enabled, the lower plug (1L) may thereafter in practice only be released and retrieved, together with the upper plug (1U). We therefore do not show the release sequence because it is understandable as an inverse sequence when the setting sequence herein is explained.

Initially Disabled Upper Plug:

The initially disabled upper bridge plug (1U) and its disconnectable connector (2U) are initially, before and during run-in and setting of the lower bridge plug (1L), temporarily disabled from being settable by any rotational and axial movements by the lock (5). In effect, except for the drag blocks (12) of the upper bridge plug (1U), it just forms another passive part of the drill pipe string (4) as seen from the lower bridge plug. Thus the deck crew may control the lower bridge plug (1U) as if it were the only bridge plug on the drill pipe string (4).

The upper ball seat sleeve (53) locks the spline sleeve (52) (mounted on the stinger (2U1)) and prevents the spline sleeve (53) and the outward facing spline dogs of the spline sleeve (52) from passing the restriction (2Ui) in the upper connector (2U), thus preventing the upper stinger (2U1) from being pushed upwardly into the upper connector (1U). Thus the J-slot mechanism, is rigid in its locked state, it may not be disconnected from the stinger, the ball valve (18U) mechanism may not be activated, the drag block barrel (121U) is not free to rotate relative to the mandrel (11U), and the upper plug (1U) is temporarily entirely disabled.

The problem of possible annular gas below the upper packer (16U) and about the intermediate drill pipe string (3) is remedied in an embodiment of the invention wherein a radial aperture (17U) in the axial bore (19U) upper stem (11U) belonging to the upper plug (1U) is covered by the drag block (18U) barrel (121U) and then being closed, and wherein the upper stem (11U) with the radial aperture (17U) is screwed downwardly when rotating the stem (11U) in the drag block barrel (121U). In this way, the radial aperture (17U) from the upper axial bore (19U) to its annulus is opened to allow gas present in the annulus to balance itself into the axial bore (19U) and the bore of the upper part of the intermediate drill pipe string (3).

Ball Seat Lock Details:

In an embodiment of the invention, the initial disabling of the upper bridge plug (1U) is made by a ball seat axial sleeve (52) arranged in a collet sleeve (53) constituting the lock (5) of the connector (2U), please see FIG. 3*a*. The ball seat axial sleeve (52) prevents the collets of the collet sleeve (53), because they may only yield inwardly, thus hanging blocked on a rim shoulder (2Ui). The ball seat axial sleeve (52) is releasable by a drop ball (51) to allow the stinger (2U1)—mounted collet sleeve (53), preferably with external dogs on collet sleeves, be forced upwardly to unlock the lock (5), thereby enabling the upper connector (2U) to be collapsed on its corresponding stinger portion (2U1) which is mounted on top of the upper plug (1U), please also see FIG. 3*b*. The force required to move the collet sleeve (53) when enabled, is in an embodiment 6½ to 7½ MT (metric tons) weight exerted by the drill pipe string (4), while other values may be selected by another mechanical designer skilled in the art.

Ball Catcher:

In an embodiment of the invention the ball (51) and the ball seat axial sleeve, hereafter called the first ball sleeve (52), may be transported by the pressure through the central bore and be caught in a ball catcher (31) at the lower end of the upper retrievable bridge plug (1U). It is undesirable that the ball and sleeve shall drop freely into the casing below the upper plug (1U) as it could interfere with the lower plug (1L) on attempting reconnecting for retrieval and also create other problems. The relative shear pressure of the first seat sleeve (52) is in an embodiment set to 69 Bar (1000 psi).

When the upper connector (2U) is enabled to be collapsed onto the stinger (2U1) of the upper plug (1U), an upper plug (1U) initiation and setting sequence may be activated.

Second Shear Seat, Anti-Rotation Pins:

In an embodiment of the invention the released downward running seat sleeve (52) will bring along with it a second shear sleeve (55), please see in the central bore (19U) between the drag block unit and the slip unit (14) in FIG. 1*a*, the second shear sleeve (55) hitherto disabling the rotational movement of the mandrel (11U) for eventually engaging the slips (14) and the packer (16). This second shear sleeve (55) has shear pins (55*s*) requiring a lower pressure to release than the first seat sleeve (52), so if the first sleeve is sheared, one will be sure that the second sleeve is also sheared almost immediately after. The second shear sleeve (55) releases upon its removal oppositely directed spring loaded anti-rotation pins (55P) inwardly, so as for allowing free rotation of the upper mandrel (11U) relative to the surrounding sleeve-shaped drag block barrel (121U), thus enabling the rotational movement for the upper slip (16U) and upper packer (14U) activation to start. The relative pressure required for the second seat sleeve (55) is 54 Bar (780 psi) in an embodiment. Other shear pressures for both shear sleeves are selectable according to the discretion of a tool designer.

Initially, for running into the well and before the lower plug (1L) is set and disconnected from the lower connector (2L), the upper drag block barrel (121U) is arranged non-rotatable relative to the mandrel (11U). In an embodiment of the invention, The anti-rotation lock is temporary and comprises spring-loaded pins (55P) which are held in engaged positions engaging the barrel (121U) with the mandrel (11U). The spring-loaded pins (55P) are held in the engaging position by a cylindrical sleeve (55) initially held by shear pins (55*s*) and which may be axially displaced downwardly by a ball or preferably by the above arranged cylindrical locking sleeve (5, 52) when that one is released by the ball (51) so as for releasing the anti-rotation pins (55P). Then the drag block (121U) barrel may be static, non-rotating in the surrounding casing due to the friction blocks (12U), while the mandrel (11U) is rotatable by the drill pipe string (4).

In an embodiment of the invention, after enabling the upper connector (2U), it is enabled for axially collapsing the upper connector (2U) and the upper stinger (2U1), please see FIG. 1*b*. The drill pipe string (4) is then able to axially operate and rotate the mandrel (11U) relative to the drag blocks (12U) barrel (121U) of the upper plug (1U) to engage its slips (14U) with the casing (0) and subsequently engaging the packer (16) to seal against the casing (0), please see also FIG. 1*c* and FIG. 1*d*.

Intermediate Drill Pipe String:

In the above, the lower and upper plugs (2L, 2U) are connected and are separated by any distance, at minimum only separated by the lower connector (2L). In an embodiment of the invention, it is advantageous to use an intermediate drill pipe string (3) below the upper plug (1U) and the lower connector (2L) on the lower plug (1L). The length of the intermediate drill pipe string (3) should only be limited to an embodiment of the invention wherein it corresponds to have a length slightly less than the distance between the lower target depth (dL) for the lower plug (1L) and the upper target depth (dU) for the upper plug (2U). This in order for allowing disconnecting from the lower plug (1L) before placing and setting the upper plug (1U). If they were still mechanically connected one could not rotate and move the upper drill pipe string (4) from topsides without affecting the lower plug (1L). A significant advantage of having an intermediate string (3) length of almost the depth difference between lower and upper target depths (dL, dU) becomes evident if the target depth difference is large: Given a lower target depth (dL) of, say 5000 m, and upper target depth (dU) of 1000 m, one would then have to run in lower plug (1L), then 4000 m of intermediate string (3), then upper plug (1U), and 1000 m of drill pipe string (4), in order to reach lower target depth. It would then be an operational advantage that when lower plug (1L) is set, the lower disconnectable connector (2L) is released, then the upper plug (1U) is near below its upper target depth (dU) and is rapidly set upon pulling out a short distance, and then after testing one may pull out the relatively short, here 1000 m of drill pipe string (4) only. Thus the two purely setting operations are conducted consecutively. Those are embodiments of the invention and may be varied with respect to relative lengths.

Free Upper Plug:

In an embodiment of the invention, the upper plug (1U) with its below mounted intermediate drill pipe string (3) is released from the lower plug (1L), and the upper plug (1U) may be enabled, not earlier. After the upper plug is enabled and also released from the lower plug (1L), any drill pipe string manipulation with rotation or axial movement, will not affect the lower plug. The upper plug may now be set and pressure tested, and if necessary, released and repositioned for further testing until satisfactory, and then disconnected.

Ball Catcher:

In an embodiment of the invention, there is arranged a ball and seat catcher (31) below the upper plug (1U) and above the lower connector (2L).

Testing Lower Plug from Below:

In an embodiment of the invention, after setting and before shutting the lower plug (1U), setting its packer (16), and then conduct pressure integrity testing the sealing effect of the lower plug's (1L) packer (16) from below by pressurizing the drill pipe string (4) topsides.

Testing Lower Plug from Above:

In a further embodiment of the above, after shutting the lower plug (1L) and disconnecting from the lower plug, conducting pressure integrity testing the lower plug (1L) from above.

Testing Upper Plug from Below:

In an embodiment of the invention, one may test the upper plug from below by after setting, before shutting the upper plug (1U), setting its packer (16), and then conduct pressure integrity testing for verifying the sealing effect of the upper plug's (1U) packer (16) from the casing space below but above the lower plug (1L) by pressurizing the drill pipe string (4) topsides.

Testing Upper Plug from Above:

Similar to above, in a further embodiment of the invention, one may test the pressure integrity of the upper plug from above by, after shutting the upper plug (1U) and disconnecting the drill pipe string (4), pressure integrity testing the upper plug (1U) from above.

If the casing to be plugged is of even diameter the upper and lower plugs (1U, 1L) are of the same diameter. In an embodiment the lower plug (1L) may be of a lower diameter than the upper plug (1U), e.g. if the lower plug (1L) shall be set in a liner below a liner hanger in a casing.

The radial aperture (17U) is kept closed during run in of upper and lower plugs (1U, 1L), setting the lower plug (1L), and pressure testing the lower plug through the drill pipe string (4, 3) from below.

The radial aperture (17U) is opened through the right-hand rotations of the mandrel (11U) described above, before setting the slips and packer (14U, 16U) of the upper plug (1U), in order to balance accumulating gas between the intermediate drill pipe string (3) and its annulus when the packer (16U) is set.

The radial aperture (17U) is closed when releasing the slips and packer (14U, 16U) so as for enabling pressurizing the intermediate drill pipe string (3) after having reconnected to the lower plug (1L) thus pressurizing the lower plug's ball valve (18L) from above before opening it. This will also enable the operator to bleeding off gas accumulated below the lower plug (1L), bleeding off gas through the intermediate drill pipe string (3) and the drill pipe string (4), providing better well control. This will prevent gas accumulation in the annulus about the drill pipe string (4).

In the above, what is called "an upper plug (1U)" with all the features belonging to the upper plug as described above, may be used alone, or used with another tool hanging below it, such as a drill string with a drilling bit, or another tool. We may thus say that an alternative definition of the invention is:

a releasable bridge plug arranged for setting in a casing (0), said tandem bridge plug (1U) comprising:

a mandrel (11U) with a through main bore (19U) with a main bore ball valve (18U) and arranged on a disconnectable connector (2U), said bridge plug (1U) characterized in that said upper bridge plug (1U) on said disconnectable connector (2U) are arranged for being initially disabled by a lock (5) and unlockable from topsides, wherein disabling of said bridge plug (1U) is initially made by a ball seat axial sleeve (52) arranged in a collet sleeve (53) constituting the lock (5) of the connector (2U), the ball seat axial sleeve (52) releasable by a drop ball (51) to allow the collet sleeve (53) be forced upwardly and unlock the lock (5), thus enabling the connector (2U) to be axially and rotationally operable relative to the plug (1U) by the drill pipe string (4), and said plug (1U) arranged for being run in on a drill pipe string (4) with said plug (1U) to a setting target depth (dU) in said casing (0);

said plug (1U) arranged for being enabled by releasing said lock (5);

said plug (1U) arranged for being set by opening a radial aperture (17U) from said through bore (19U), setting a packer (16U) of said plug (1U), said packer (16U) arranged above said radial aperture (17U); said plug's (1U) packer (16U) arranged for being pressure integrity tested for its sealing effect from below by pressurizing the drill pipe string (4) topsides, said plug (1U) arranged for being shut by closing said ball valve (18U);

said connector (2U) arranged for disconnecting said plug (1U) from said drill pipe string (4) above it.

ADVANTAGES

A first problem of setting two plugs in one run is thus solved by the invention. This reduces the setting time for two plugs by about 50%. Time is costly both from an economical and a safety view; a drilling rig and particularly a marine drilling platform has high day rates. Time may be costly from a safety point of view if the two plugs are to be set fast in order to remedy an undesired state of the well. The invention has several further significant advantages.

Another problem, of not being able to set two plugs during a safety disconnect operation is solved by the invention. First, if the lower plug is set with the hang-off drill string below, then the most imperative problem is solved, the well is plugged by one plug, and one may leave the well in an emergency. If time allows, one may quickly set the upper plug as a backup to reduce the risk of blow out, and then disconnect and prepare to leave the well.

A further problem of not being able to conduct a single run pressure testing for leak location in a casing string is solved.

A further advantage of the invention is that accumulated gas in the annulus below the upper packer (16U) is vented into the central bore of the upper plug before releasing the upper packer. This is particularly useful if an extensive string of intermediate drill pipe string sections (3) are arranged extending below the upper plug and extending down to the lower connector (2L); this gas would otherwise be vented out in the drill pipe string (4) annulus above the upper packer (4) when releasing the packer, which would be undesirable.

The invention claimed is:

1. A method of setting a tandem releasable bridge plug system in a casing comprising the steps of:

assembling a tandem bridge plug string comprising from bottom to top:

a lower bridge plug with mandrel with a through-bore having a main bore ball valve-and arranged on a lower, disconnectable connector; and an upper bridge plug with a through-bore having a main bore ball valve and arranged on an upper, disconnectable connector, said upper bridge plug and said upper connector being initially disabled by a lock and being unlockable from topsides thereof, wherein disabling of said upper bridge plug is initially made by a ball seat axial sleeve arranged in a collet sleeve constituting said lock of said connector, said ball seat axial sleeve being releasable by a drop ball to allow said collet sleeve to be forced upwardly and unlock said lock enabling said upper connector to be axially and rotationally operable relative to the upper plug by a drill pipe string;

running in said tandem plug string on the drill pipe string until said lower plug is at a setting target depth thereof in the casing;

setting said lower plug;

setting a packer of said lower plug;

pressure integrity testing a sealing effect of a packer of said lower plug from below by pressurizing the drill pipe string topsides, and shutting said ball valve of said lower plug;

disconnecting said upper plug from said lower plug;

pulling up said upper plug to an upper setting target depth thereof in the casing;

enabling said upper plug by unlocking said lock;

setting said upper plug and opening a radial aperture extending from said through bore of said mandrel, setting a packer of the upper plug, said packer of the upper plug being arranged above said radial aperture;

pressure integrity testing a sealing effect of said packer of the upper plug from below by pressurizing said drill pipe string topsides, and shutting said ball valve of said upper plug; and disconnecting said drill pipe string from said upper plug.

2. The method of claim 1, wherein said ball seat sleeve, when released, runs downwardly and brings along with it a second shear seat sleeve initially holding anti-rotation pins disabling rotational movement of said drill pipe string from engaging slips and packer of said upper plug, wherein after enabling said upper connector and said upper plug, using said upper connector to operate on said upper plug and rotate said drill pipe string thus said mandrel relative to said drag blocks of said upper plug to engage its slips with the casing and subsequently engaging said packer to seal against the casing.

3. The method of claim 1, further comprising using an intermediate drill pipe string below said upper plug and above said lower connector on said lower plug.

4. The method of claim 1, further comprising using a ball and seat catcher below said upper plug and above said lower connector.

5. The method of claim 1, further comprising, after shutting said lower plug and disconnecting said lower connector from said lower plug, pressure integrity testing said lower plug from above.

6. The method of claim 1, further comprising, after shutting said upper plug and disconnecting said upper connector on said drill pipe string from said upper plug, pressure integrity testing said upper plug from above.

7. The method of claim 1, wherein the step of setting said lower plug comprises:

while allowing a lower set of drag blocks of said lower plug to drag on an inner wall of said casing, activating a lower set of slips of said lower plug to engage and hold on said inner wall of said casing;

activating the packer of said lower plug to seal against said inner wall of said casing; and activating the ball valve to shut the central bore of said lower plug.

8. The method of claim 1, wherein the step of setting said upper plug comprises:

while allowing the upper drag blocks of said upper plug to drag on an inner wall of said casing, activating upper slips of said upper plug to engage and hold on said inner wall of said casing;

activating the packer of said upper plug to seal against said inner wall of said casing; and activating an upper ball valve to shut the central bore of said upper plug.

9. The method of claim 7, wherein the step of setting of the lower plug comprises:

while allowing the lower set of drag blocks to friction hold on said inner wall of said casing, rotating said drill pipe string right hand and applying axial weight for activating a lower set of slips to engage and hold on said inner wall of said casing, and activating a lower set of seals to seal against said inner wall of said casing; and-rotating left hand for activating the lower ball valve to shut the central bore of the lower plug.

10. The method of claim 1, wherein the step of setting said upper plug by manipulating said drill pipe string topsides comprises:

dropping said ball through said drill pipe string to enable axial and rotational movement of said upper connector relative to said upper plug;

while allowing the upper blocks of said upper plug to friction hold on said inner wall of said casing, rotating said drill pipe string right hand and applying axial weight for activating the upper slips of said upper plug to engage and hold on the inner wall of the casing, and activating the packer of said upper plug to seal against the inner wall of the casing; and rotating said drill pipe string left hand for activating the upper ball valve to shut said central bore of said upper plug.

11. A tandem releasable bridge plug system arranged for setting in a casing, comprising:

a tandem bridge plug string comprising from bottom to top:

a lower bridge plug having a mandrel with an upper main bore with an upper main bore lower ball valve and arranged on a lower, disconnectable lower connector; and an upper bridge plug having a mandrel with a lower main bore with a lower main bore upper ball valve and arranged on an upper, disconnectable connector, wherein said tandem bridge plug string further comprises:

said upper bridge plug arranged on said upper, disconnectable connector, said upper bridge plug and said upper connector being arranged for being initially disabled by a lock and unlockable from topsides thereof, wherein disabling of said upper bridge plug is initially made by a ball seat axial sleeve arranged in a collet sleeve constituting said lock of said upper connector, said ball seat axial sleeve being releasable by a drop ball to allow said collet sleeve to be forced upwardly and unlock said lock, thus enabling said upper connector to be axially and rotationally operable relative to said upper plug by a drill pipe string;

said tandem plug string arranged for being run in on a drill pipe string with said lower plug to a lower plug setting target depth in said casing;

said lower plug arranged for being set in said casing, and thereafter setting a lower packer-of said lower plug;

said lower plug arranged for pressure integrity testing of a sealing effect of the lower packer from below by pressurizing said drill pipe string topsides, said lower plug arranged for being shut by closing said lower ball valve;

said lower connector arranged for disconnecting said lower plug from said upper plug;

said upper plug arranged for being pulled up to an upper plug setting target depth in the casing;

said upper plug arranged for being enabled by releasing said lock;

said upper plug arranged for being set by opening a radial aperture from said upper main bore, setting an upper packer of said upper plug, said upper packer arranged above said radial aperture; said upper packer of said upper plug arranged for being pressure integrity tested for its sealing effect from below by pressurizing said drill pipe string topsides, said upper plug arranged for being shut by closing the upper ball valve of said upper plug; and said upper connector on said drill pipe string arranged for disconnecting from said upper plug.

12. The system of claim 11, wherein a ball seat axial sleeve is arranged for, when released, to run downwardly and bring along with it a second shear seat sleeve, said second shear seat sleeve initially holding anti-rotation pins, said anti-rotation pins initially disabling rotational movement of said drill pipe string from engaging upper slips and said upper packer of said upper plug, wherein after said upper connector being enabled, said upper connector is arranged to axially and rotationally operate on said upper plug and rotate said drill pipe string thus said mandrel relative to said upper drag blocks of said upper plug to engage said upper slips of said upper plug with said casing and for engaging said upper packer of said upper plug to seal against the casing.

13. The system of claim 11, comprising an intermediate drill pipe string arranged below said upper plug and above said lower connector on said lower plug.

14. The system of claim 11, comprising a ball and seat catcher arranged below said upper plug and above said lower connector.

15. The system of claim 11, wherein said lower plug is arranged for setting of said lower plug by comprising:

lower drag blocks arranged to drag on an inner wall of said casing;

lower slips arranged to engage and hold on said inner wall of said casing;

the lower packer arranged to seal against said inner wall of said casing; and said lower ball valve arranged to shut said central bore.

16. The system of claim 11, wherein said upper plug comprises, for setting of said upper plug:

upper drag blocks arranged to drag on an inner wall of said casing;

upper slips arranged to engage and hold on said inner wall of said casing;

said upper packer arranged to seal against the inner wall of said casing; and said upper ball valve of said upper plug arranged to shut the central bore.

17. The system of claim 15, said lower plug comprises, for setting of said lower plug:

lower drag blocks to friction on the casing inner wall;

said lower slips arranged for being activated by rotating said drill pipe string right-hand and applying axial weight which causes said lower slips to engage and hold on said inner wall of said casing and activating lower packers to seal against said inner wall of said casing; and said lower ball valve arranged for being activated and shut by left-hand rotation by said drill pipe string.

18. The system of claim 11, said upper plug arranged for being manipulated using said drill pipe string topsides during setting, comprising:

said ball arranged for being dropped through said drill pipe string to unlock said lock of said upper connector and said upper plug to enable axial and rotational movement of the upper connector relative to said upper plug;

said upper drag blocks arranged to drag on casing's the inner wall of said casing;

said upper slips arranged for being activated by said drill pipe string being right hand rotated and axial weight loaded to engage and hold said upper slips on said inner wall of said casing and for engaging said upper packers to seal against said inner wall of said casing; and said upper ball valve arranged for being activated by rotating said drill pipe string left hand to shut for closing central bore.

19. The system of claim 11, said disconnectable connector comprising a J-slot in said central bore arranged for receiving a top stinger with a dog, said top stinger arranged on top of said upper plug.

20. The system of claim 11, wherein said radial aperture extends orthogonally from the axial bore of said upper mandrel of said upper plug, and is covered in its closed state by a drag block barrel which is axially movable along said mandrel, wherein an annular seal is arranged internally and near a lower end of said drag block barrel to seal said radial aperture when closed, and to uncover said radial aperture when said barrel is moved in an opposite direction along said mandrel.

21. The system of claim 11, wherein a drag block barrel has ratchet blocks held spring-loaded in an inward facing annular pocket and having threads arranged for running on a composite thread portion of said mandrel, said composite thread portion comprising an upper, left-hand thread portion, an intermediate blank section, and a lower right-hand threaded portion, so as for enabling axial movement of said mandrel relative to said drag block barrel.

22. The system of claim 21, wherein said lower, right-hand threaded portion has a larger diameter than said upper, left-hand threaded portion, and said ratchet blocks-have a larger diameter in a lower portion for engaging said lower, right-hand threaded portion and a smaller diameter at an upper portion for engaging said upper, left-hand threaded portion.

23. The system of claim 11, wherein an upper stinger on top of said upper plug is initially locked by said lock in said connector and arranged on top of an upper ball valve section of said upper plug, and is connected to an upper barrel with a clutch to a lower barrel which holds an upper ball valve element of said upper ball valve, wherein said clutch initially is held in an engaged state wherein said clutch engages rotationally said upper barrel to said lower barrel, forcing common rotation, and arranged for being axially compressed the so as for said upper barrel and said lower barrel to release said two barrels rotationally from each other due to initially engaging finger-and-slot arrangements held by shear screws which will disengage in their compressed position, so as for rotation of said upper barrel relative to said lower barrel may occur thus rotating said ball valve element of said ball valve to close or open.

24. A releasable bridge plug arranged for setting in a casing, said bridge plug comprising:

a mandrel with a through bore with a main bore ball valve and arranged on a disconnectable connector;

said bridge plug on said disconnectable connector arranged for being initially disabled by a lock and unlockable from topsides, wherein disabling of said bridge plug is initially made by a ball seat axial sleeve arranged in a collet sleeve constituting said lock of said connector, said ball seat axial sleeve releasable by a drop ball to allow said collet sleeve to be forced upwardly and unlock said lock, thus enabling said connector to be axially and rotationally operable relative to said plug by a drill pipe string;

said bridge plug arranged for being run in on a drill pipe string with said plug to a plug setting target depth in said casing;

said bridge plug arranged for being enabled by releasing said lock;

said bridge plug arranged for being set by the sequence of opening a radial aperture from said through bore, and setting a packer of said plug, said packer of said plug arranged above said radial aperture;

said packer of said plug arranged for being pressure integrity tested for a sealing effect of said plug from below by pressurizing said drill pipe string topsides, said plug arranged for being shut by closing the main bore ball valve arranged above said packer; and said connector arranged for disconnecting said plug from said drill pipe string thereabove.

* * * * *